United States Patent [19]

Seitz

[11] Patent Number: 4,717,389

[45] Date of Patent: Jan. 5, 1988

[54] HAIR-RESERVING DYEING OF WOOL- AND FUR-BEARING SKINS

[75] Inventor: Rudolf Seitz, Ormalingen, Switzerland

[73] Assignee: Sandoz Ltd., Basel, Switzerland

[21] Appl. No.: 868,459

[22] Filed: May 30, 1986

[30] Foreign Application Priority Data

Jun. 5, 1985 [DE] Fed. Rep. of Germany ..... 3520105

[51] Int. Cl.[4] ..... D06P 3/04; D06P 3/32

[52] U.S. Cl. ..... 8/436; 8/404; 8/446; 8/602; 8/650; 8/652

[58] Field of Search ..... 8/436, 404, 490, 549, 8/546, 904, 907, 909, 910, 446, 449, 453, 465, 602, 650, 652

[56] References Cited

U.S. PATENT DOCUMENTS

| | | | |
|---|---|---|---|
| 3,273,954 | 9/1966 | Wachsmann et al. | 8/907 |
| 3,334,960 | 8/1967 | Abel | 8/604 |
| 3,472,605 | 10/1969 | Wicki et al. | 8/436 |
| 3,926,546 | 12/1975 | Nickel et al. | 8/436 |
| 4,272,243 | 6/1981 | Lach et al. | 8/436 |

FOREIGN PATENT DOCUMENTS

| | | |
|---|---|---|
| 2539671 | 3/1976 | Fed. Rep. of Germany . |
| 705335 | 3/1954 | United Kingdom . |
| 1502966 | 3/1978 | United Kingdom . |

*Primary Examiner*—Paul Lieberman
*Assistant Examiner*—Linda D. Skaling
*Attorney, Agent, or Firm*—Gerald D. Sharkin; Richard E. Vila; Thomas C. Doyle

[57] ABSTRACT

A hair-reserving penetration dyeing of the leather side of wool- or fur-bearing skins is obtained by dyeing the wooled or fur skins in aqueous medium with hydrosoluble sulpho-group-containing sulphur dyes (a) in the presence of dye-substantive uptake assistant (b) and of non-ionic and/or anionic hydrophilic dispersants (c) and optionally in the presence of leather fatting agents (d).

29 Claims, No Drawings

HAIR-RESERVING DYEING OF WOOL- AND FUR-BEARING SKINS

The invention relates to a process for dyeing wool- and fur-bearing skins with hydrosoluble sulphur dyes containing sulpho groups together with particular assistants, by which the hair side of the skin remains practically completely reserved, whereas the leather side is optimally penetration dyed.

Thus, the invention provides a process for the dyeing of the leather side of wool- and fur-bearing skins, wherein the wool- or fur-bearing skins are dyed in aqueous medium with (a) a hydrosoluble, sulpho group-containing sulphur dye or a mixture of such dyes in the presence of (b) a dye-substantive uptake assistant or a mixture of such assistants and (c) a non-ionic or anionic hydrophilic dispersant or a mixture of such dispersants.

Any kind of tanned wool- and fur-bearing skins commonly used as substrate for dyeing from aqueous media may be used for the process of the invention, particularly skins that bear wool hair and optionally also awns and derive from any wool- or fur-bearing animals, e.g. from sheep, lamb, goat, calf, colt, rabbit and fine fur bearing animals. Wool-bearing skins, in particular goatskin, sheepskin and lambskin are the ones most used for leather-side dyeing and are consequently, also preferred for the process of the invention. The skins may have been tanned by any usual tanning method, e.g. mineral, vegetable, synthetic or combined tanning of which the mineral or combined tanning method is preferred. Goatskins, lambskins and sheepskins are preferably chrome-tanned; furs, preferably fine furs, are preferably aluminium-tanned or optionally also aldehyde-tanned. If desired the flesh side of the skin may be sueded after tanning. A suede finish of the flesh side is particularly preferred for wool-bearing skins, in particular sheep-, lamb- or goatskins. If desired the skins may be retanned, neutralised, remasked and/or fatted before the dyeing process of the invention.

The dyes to be used according to the invention are hydrosoluble, sulpho group-containing sulphur dyes, especially so-called "Bunte salts" as defined, e.g. in Venkataraman "The Chemistry of Synthetic Dyes", vol. VII, 1974, Academic Press in chapter II, on pages 35–68, preferably such as defined and listed in the Colour Index, under the headings "Solubilised Sulphur Dyes" and "Condense Sulphur Dyes". They may be employed in the usual commercial forms.

The dye-substantive uptake assistant (b) may be any such assistant, as is usually employed in dyeing with anionic dyestuffs from aqueous media. Preferred assistants are highly oxyethylated and optionally quaternized surface-active fatty amines or fatty aminoalkylamines. The fat radical in the fatty amines or fatty aminoalkylamines is advantageously an aliphatic linear hydrocarbon radical with at least 12 carbon atoms, preferably alkyl or alkenyl with 16–22 carbon atoms. The alkylene bridge in the fatty aminoalkylamines contains advantageously 2–6 carbon atoms and is preferably a linear polymethylene, preferably ethylene, propylene or hexamethylene, of which propylene is particularly preferred. The degree of oxyethylation is advantageously such that at least 20 moles of ethylene oxide are added per mole of fatty amine or fatty aminoalkylamine; preferably the degree of oxyethylation is in the range of 20–110, in particular for quaternized products in the range of 20–70, preferably 25–50 and for non-quaternized products in the range of 50–110, preferably 70–110. By the quaternization there are preferably introduced methyl or ethyl groups (preferably methyl) and the counter-ion is preferably the one corresponding to the quaternizing agent employed for quaternization, preferably methosulphate, ethosulphate or a halide (iodide, bromide or preferably chloride). Preferred dye-substantive uptake assistants correspond to the average formula

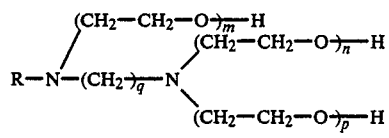

(I)

wherein

R signifies alkyl or alkenyl with 16–22 carbon atoms q is a whole number from 2 to 6, preferably 3;

m, n and p are each at least one;

and the sum m+n+p is 20–110;

or to quaternization products thereof.

By the quaternization there is introduced preferably at least one methyl or ethyl group.

Particularly preferred uptake assistants are the following: tallow fatty aminopropylamine, oxyethylated with 30–35 moles of ethylene-oxide and mono-quaternized with dimethyl sulphate; tallow fatty aminopropylamine, oxyethylated with 100 moles of ethylene oxides; behenyl aminopropylamine and/or arachidyl aminopropylamine, oxyethylated with 100–105 moles of ethylene oxide. The non-quaternary uptake assistants are preferred for the process of the invention.

The hydrophilic dispersant (c) is preferably selected from oil-in-water emulsifiers and is more preferably hydrosoluble. The HLB-value of the non-ionic oil-in-water emulsifier is preferably at least 6, more preferably 7–18, in particular 7–16. Particular categories of suitable non-ionic emulsifiers are oxyethylation products of fatty acids, fatty amides, fatty alcohols or mono- or dialkylphenols or of mono- or difatty acid esters of sorbitol, which may also contain propyleneoxy units. The fatty radicals contain preferably 9–24, more preferably 12–22 carbon atoms and the corresponding hydrocarbon radicals may be conventional alkyl and/or alkenyl radicals. In the mono- and dialkylphenols the alkyl radicals contain advantageously 4–12 carbon atoms, the whole of the mono- or dialkylphenyl radical containing preferably 14–24 carbon atoms. Representative fatty acids are the following: lauric, palmitic, myristic, oleic, stearic, arachidic and behenic acid and technical mixtures such as coconut fatty acid and tallow fatty acid. The fatty acid amides are preferably amides of the above-mentioned acids. The fatty alcohols may be the alcohols corresponding to the above-mentioned fatty acids or also synthetic branched-chain alcohols. Particular alkyl substituted phenols include dibutylphenol, isooctylphenol, mono- or dinonylphenol and monododecylphenol. The sorbitan esters are preferably sorbitan mono- and dioleate and sorbitan·mono- and distearate. The degree of oxyethylation is suitably chosen so that the HLB-value is in the indicated range; the degree of oxyethylation for the non-ionic dispersant (c) is advantageously in the range of 3–70, preferably in the range of 3–50, more preferably 4–30.

The anionic oil-in-water emulsifiers are advantageously more weakly anionic than the dyestuffs which are used, and are preferably hydrosoluble carboxylic acids, which are more preferably in salt form. Representative hydrosoluble carboxylic acids are, in particular, carboxymethylation products of the above-mentioned nonionic emulsifiers, preferably the carboxymethylation products of the oxyethylated fatty alcohols and of the oxyethylated mono- or dialkylphenols. Further anionic emulsifiers that may be used according to the invention are phosphoric acid partial esters of optionally oxyethylated higher fatty alcohols, wherein the alcohols may be as defined above and wherein the partial esters are optionally in salt form. The anionic emulsifiers may be in the form of salts of conventional cations, preferably alkali metal cations (sodium, lithium, potassium) or ammonium (unsubstituted ammonium or ammonium substituted by $C_{1-2}$-alkyl and/or $C_{2-3}$-alkanol, e.g. mono-, di- or triethanol- or -isopropanolammonium).

Preferably at least a portion of the dispersant (c) is a non-ionic oil-in-water emulsifier. Advantageously at least 10 weight %, preferably at least 30 weight %, more preferably at least 50 weight % of the employed emulsifier (c) is a non-ionic emulsifier. More preferably only one or more non-ionic emulsifiers are used as the component (c).

The dye concentration may range in a very broad scope and may be chosen depending on the substrate, on the dye and on the desired colour effect; the dye concentration lies in general preferably in the range of from 0.05 to 10 weight %, more preferably from 0.2 to 5 weight % based on the weight of the intermediately dried skin.

Per 100 parts by weight of component (a) there are employed advantageously 2–200 parts by weight, preferably 5–100 parts by weight, more preferably 10–50 parts by weight of component (b).

Per 100 parts by weight of component (a) there are employed advantageously 2–500 parts by weight, preferably 5–200 parts by weight, more preferably 10–100 parts by weight of component (c).

The dyeing is carried out in aqueous medium, advantageously under mild temperature conditions, preferably in the temperature range of from 15°–40° C., more preferably 15°–25° C. The pH-value lies advantageously in the range of from 3.5–9, the pH at the beginning of the dyeing being preferably in the range of 6–8 and at the end of the dyeing procedure at lower values (by acid addition) preferably in the range of from 3.5–5. For setting the pH-values there may be used acid and bases conventional in the dyeing of leather, e.g. ammonia, alkali metal carbonates, bicarbonates, formates, acetates or phosphates, hydrochloric acid, sulphuric acid, acetic acid, formic acid or tartaric acid.

According to a particular aspect of the process of the invention, a leather fatting agent (d), preferably a dispersed leather fatting agent (a fat liquor) may be added to the dyeing liquor. In general any non-ionically or anionically dispersed natural leather-fatting agent or chemically modified natural leather-fatting agent may be employed, in particular any conventional natural animal, vegetable or mineral fat, fat oil, wax, resin or resin oil or chemically modified animal or vegetable fats or oils, including: tallow, fish oils, neats foot oil, olive oil, castor oil, rapeseed oil, linseed oil, wood oil, cottonseed oil, sesame oil, corn oil and japanese tallow and chemically modified products thereof (e.g. hydrolysis, ammonolysis, transesterification, oxidation, hydrogenation and sulphation products), bees wax, chinese wax, carnauba wax, montan wax, wool fat, colophony, birch oil, shellack, mineral oils with boiling range within 300° and 370° C. (particularly so-called "heavy alkylates"), soft parffin, medium paraffin, hard paraffin, vaseline, ceresine and methyl esters of $C_{14-22}$ fatty acids. Preferred fatting agents are chemically unmodified natural fatting agents and methyl esters of $C_{14-22}$-fatty acids, particularly tallow, fish oils, neats foot oil, olive oil, castor oil, paraffins, vaseline, mineral oil, ceresin, wool fat, methyl esters of $C_{14-22}$ fatty acids and "heavy alkylates". Particularly preferred are wool fat and "heavy alkylates". The fats may be dispersed in water by means of non-ionic and/or anionic surfactants such as those described above or also by chemical modification of the fats, e.g. by hydrolysis, ammonolysis and/or sulphation by which the corresponding fatty acids, fatty acid amides, sulphated or sulphonated fats are formed, which may also act as emulsifiers. In the fatting agent dispersions, there may be also employed non-ionic surfactants with a higher HLB-value or a higher degree of oxyethylation than indicated above, e.g. such of the above indicated products which, however, contain on the average up to 100 ethylene oxide units per molecule and/or their carboxymethylation products. In general, any leather fatting agent dispersion conventionally used for the fatting of leather may be employed, of which, however, those that do not contain any strongly anionic surfactants (in particular those that do not contain surfactants with sulpho groups) are preferred. Advantageously the fatting agents (d) are used in the form of dispersions that contain per 100 parts by weight of pure fat 30–300 parts by weight, preferably 50–200 parts by weight of total surfactants. The dry content of these dispersions is preferably 10–90, more preferably 30–60% per weight, referred to the total weight of the dispersion.

The component (d) may already be efficient in very low concentrations and is added e.g. in concentrations of 0.2–10% by weight, based on the weight of the intermediately dried substrate. Very good reserve effects on the dyeings are obtained with fat concentrations of 0.2–4, preferably 0.5–2% by weight.

The dyed skins may, if desired, be subjected to further treatment and may, for example, be refatted or treated with a water-repellant finish, the flesh side may be treated with further conventional finishing agents, e.g. may be embossed with the assistance of suitable binding agents or lacquers or may be coated or printed with dyestuff-containing compositions. The hair side may be finished in the conventional way, e.g. by shearing or brushing as required.

By the process of the invention there are obtained dyed wool- and fur-bearing skins optimally reserved on the hair side and optimally penetration dyed on the leather side. The dyeings are of notable wet and dry fastness, in particular of notable light-fastness, fastness to rubbing, to water, to water-drops, to dry-cleaning and to washing. The hair side is substantially undamaged. In order to obtain particular bicolour effects of hair and leather side, it is also possible to dye the hair side (and optionally also the leather side) with a wool-substantive dyestuff, after which the leather side may be dyed by the process of the invention.

In the following examples parts and percentages are by weight and the temperatures are indicated in degrees Celsius.

EXAMPLE 1

(Drum-dyeing)

100 parts of intermediately dried English sueded wooled sheepskins are treated in the drum for 30 minutes at 20° with 2000 parts of an aqueous liquor containing 1 g/l of sodium bicarbonate, 1 g/l of a 25% aqueous ammonia solution and 0.5 g/l of poly(6.5)ethyleneglycol monooleate. Upon addition of 0.5 g/l of a dye-substantive uptake assistant of formula (I) in which R is a mixture of behenyl and arachidyl, q is 3 and the sum m+n+p is 105, the treatment of the skin is continued for further 10 minutes. Then there are added 1.5 g/l of the fatting agent dispersion indicated below and 1.5 g/l of C.I. Solubilised Sulphur Brown 14 and dyeing is continued for 60 minutes at 20°. Upon addition of 1.0 g/l of 85% acetic acid, treatment is continued for a further hour at 20°. Then the skins are rinsed with water at 35° and washed; refatting is carried out at 35° in a fresh aqueous liquor containing 1.0 g/l of the fatting agent dispersion indicated below and 2.0 g/l of a 60% aqueous dispersion of a sulphated fish-oil. Treatment is continued for 30 minutes with this liquor, after which the skins are dried, conditioned, shaken, combed, sheared, ironed, sheared again and brushed. The leather side of the obtained shearling is penetration dyed in a level brown shade of optimal fastness and the hair side is optimally reserved.

The composition of the fatting agent dispersion is as follows:

295 parts of tallow fatty acid methyl ester
15 parts of oleic acid
30 parts of stearic acid
40 parts of poly(60)ethyleneglycol monooleylether
80 parts of the carboxymethylated decaethyleneglykol monoether of tallow fatty alcohol
water up to a total of 1000 parts of dispersion.

By repeating the process of the above example 1 but employing the following C.I. dyestuffs in place of C.I. Solubilised Sulphur Brown 14:

C.I. Solubilised Sulphur Red 6
C.I. Solubilised Sulphur Brown 10
C.I. Solubilised Sulphur Black 1
C.I. Solubilised Sulphur Blue 11 sueded shearlings of optimally reserved hair side and optimally penetration dyed leather side are obtained.

EXAMPLE 2

The process of example 1 is repeated with the modification that in place of 1.0 g/l of the leather fatting agent dispersion, there are employed further 0.5 g/l of the poly(6.5)ethyleneglycol monooleate. An optimally dyed sueded shearling is obtained in which the hair side is optimally reserved.

What is claimed is:

1. A process for dyeing the leather side of a tanned wool- or fur-bearing skin which comprises dyeing said skin in an aqueous medium with (a) a hydrosoluble sulpho group-containing sulphur dye or a mixture of such dyes in the presence of (b) a dye-substantive uptake assistant or a mixture of such assistants and (c) a non-ionic or anionic hydrophilic dispersant or mixture of such dispersants, there being employed 2–200 parts by weight of (b) and 2–500 parts by weight of (c) per 100 parts by weight of (a).

2. A process according to claim 1, wherein (b) is a highly oxyethylated or nonquaternized surface-active fatty amine or fatty aminoalkylamine or a mixture thereof.

3. A process according to claim 2, wherein the dye-substantive uptake assistant has the average formula

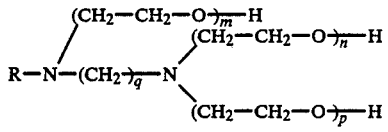

(I)

wherein

R is alkyl or alkenyl with 16 to 22 carbon atoms;
q is a whole number from 2 to 6;
m, n and p are each independently at least 1;
and the sum m+n+p is 20–110;
or is a quaternization product thereof.

4. A process according to claim 1, wherein the dispersant comprises one or more non-ionic dispersants with an HLB of at least 6.

5. A process according to claim 1, wherein the dispersant comprises one or more anionic hydrosoluble carboxy group-containing dispersants.

6. A process according to claim 2 wherein component (c) comprises at least one non-ionic dispersant having an HLB-value of at least 6 or at least one anionic hydrosoluble carboxy group-containing dispersant or a mixture of such dispersants.

7. A process according to claim 2 wherein, in component (b), the fatty radical is an aliphatic linear hydrocarbon radical with at least 12 carbon atoms and the degree of oxyethylation is at least 20 mols of ethylene oxide per mol of fatty amine or fatty aminoalkylamine and the alkylene bridge in the fatty aminoalkylamine contains 2 to 6 carbon atoms.

8. A process according to claim 2 wherein the dyeing is carried out at a temperature in the range 15°–40° C. and a pH in the range 3.5–9.

9. A process according to claim 3 wherein component (c) comprises at least one non-ionic dispersant having an HLB-value of at least 6 or at least one anionic hydrosuluble carboxy group-containing dispersant or a mixture of such dispersants.

10. A process according to claim 3 wherein component (c) comprises one or more non-ionic oil-in-water emulsifiers having an HLB-value of 7–18.

11. A process according to claim 3 wherein the dyeing is carried out at a temperature in the range 15°–40° C. and a pH in the range 3.5–9.

12. A process according to claim 1 wherein the dyeing is carried out in the presence of (d) a natural or chemically modified natural leather-fatting agent, which is non-ionically, anionically or both non-ionically and anionically emulsified.

13. A process according to claim 1, wherein component (a) is used in a concentration of 0.05 to 10 weight %, based on the intermediately dried skin.

14. A process according to claim 12, wherein component (d) is employed in concentrations of 0.2–10% by weight, based on the intermediately dried skin.

15. A process according to claim 12 wherein the dyeing is carried out at a temperature in the range 15°–40° C. and a pH in the range 3.5–9.

16. A process according to claim 6 wherein the dyeing is carried out in the presence of (d) a natural or chemically modified natural leather-fatting agent, which is non-ionically, anionically or both non-ionically and anionically emulsified.

17. A process according to claim 16 wherein the dyeing is carried out at a temperature in the range 15°–40° C. and a pH in the range 3.5–9.

18. A process according to claim 6 wherein the dyeing is carried out at a temperature in the range 15°–40° C. and a pH in the range 3.5–9.

19. A process according to claim 7 wherein the dyeing is carried out at a temperature in the range 15°–40° C. and a pH in the range 3.5–9.

20. A process according to claim 9 wherein, per 100 parts by weight of component (a), there are employed 5–100 parts by weight component (b) and 5–200 parts by weight component (c) and the dyeing is carried out at a temperature in the range 15°–40° C. and a pH in the range 6–8 at the beginning of the dyeing and in the range 3.5–5 at the end of the dyeing.

21. A process according to claim 10 wherein, per 100 parts by weight of component (a), there are employed 5–100 parts by weight component (b) and 5–200 parts by weight component (c) and the dyeing is carried out at a temperature in the range 15°–40° C. and a pH in the range 6–8 at the beginning of the dyeing and in the range 3.5–5 at the end of the dyeing.

22. A process according to claim 20 wherein the dyeing is carried out in the presence of (d) a natural or chemically modified natural leather-fatting agent, which is non-ionically, anionically or both non-ionically and anionically emulsified.

23. A process according to claim 20 wherein component (b) is selected from the group consisting of tallow fatty aminopropylamine oxyethylated with 30–35 moles of ethylene oxide and mono-quaternized with dimethyl sulphate, tallow fatty aminopropylamine oxyethylated with 100 moles of ethylene oxide and behenyl aminopropylamine or arachidyl aminopropylamine or a mixture thereof oxyethylated with 100–105 moles of ethylene oxide.

24. A process according to claim 21 wherein component (b) is selected from the group consisting of tallow fatty aminopropylamine oxyethylated with 30–35 moles of ethylene oxide and mono-quaternized with dimethyl sulphate, tallow fatty aminopropylamine oxyethylated with 100 moles of ethylene oxide and behenyl aminopropylamine or arachidyl aminopropylamine or a mixture thereof oxyethylated with 100–105 moles of ethylene oxide.

25. A process according to claim 22 wherein component (d) is employed in a concentration of 0.05 to 10 weight percent, based on the weight of the intermediately dried skin.

26. Tanned wool- or fur-bearing skin dyed on the leather side by the process of claim 1.

27. Wool- and fur-bearing skin dyed on the leather side by the process of claim 6.

28. Wool- and fur-bearing skin dyed on the leather side by the process of claim 16.

29. Wool- or fur-bearing skin dyed on the leather side by the process of claim 21.

* * * * *